US006003806A

United States Patent [19]

Simon

[11] Patent Number: 6,003,806

[45] Date of Patent: Dec. 21, 1999

[54] METHOD FOR PREVENTING PATTERN WINDINGS IN RANDOM WOUND YARN PACKAGES

[75] Inventor: Karsten Simon, Mönchengladbach, Germany

[73] Assignee: W. Schlafhorst AG & Co., Germany

[21] Appl. No.: 08/893,269

[22] Filed: Jul. 15, 1997

[30] Foreign Application Priority Data

Jul. 15, 1996 [DE] Germany ..... 196 28 402

[51] Int. Cl.[6] ..... B65H 54/38

[52] U.S. Cl. ..... 242/477.6; 242/477.8

[58] Field of Search ..... 242/477.4, 477.5, 242/477.6, 477.7, 477.8

[56] References Cited

U.S. PATENT DOCUMENTS

| | | | |
|---|---|---|---|
| 4,049,211 | 9/1977 | Spescha | 242/477.4 X |
| 4,060,208 | 11/1977 | Raasch | 242/477.4 |
| 4,296,889 | 10/1981 | Martens | 242/477.6 |
| 4,377,263 | 3/1983 | Guelpa | 242/477.6 |
| 5,056,724 | 10/1991 | Prodi et al. | 242/477.6 |
| 5,328,111 | 7/1994 | Franzolini | 242/477.5 |
| 5,577,676 | 11/1996 | Berger et al. | 242/477.6 X |

FOREIGN PATENT DOCUMENTS

| | | |
|---|---|---|
| 25 34 239 A1 | 2/1977 | Germany . |
| 35 21 152 A1 | 12/1986 | Germany . |
| 43 37 891 A1 | 5/1995 | Germany . |
| 215637 | 11/1941 | Switzerland . |

*Primary Examiner*—Michael R. Mansen
*Attorney, Agent, or Firm*—Kennedy Covington Lobdell & Hickman

[57] ABSTRACT

In a simplified method for preventing pattern windings in a winding process for producing random wound yarn packages at a winding station of a winding machine, either the circumferential speed of a yarn package or the traversing speed of a yarn guide is selected as a command variable and the other as a secondary variable. Then, in the winding process the winding roller of the winding station is accelerated and decelerated and the yarn guide is accelerated and decelerated so that each variable varies between respective predetermined maximum and minimum values. Each time the command variable reaches a predetermined maximum or minimum value, a signal is generated and: if a previous change in the secondary variable immediately prior to the generating of the signal was an increase in the secondary variable, then the secondary variable is decreased in response to the signal; and if a previous change in the secondary variable immediately prior to the generating of the signal was a decrease in the secondary variable, then the secondary variable is increased. Furthermore, if during the winding process the secondary variable equals a predetermined value, then the secondary variable is maintained at the predetermined value until a signal is generated.

19 Claims, 4 Drawing Sheets

METHOD FOR PREVENTING PATTERN WINDINGS IN RANDOM WOUND YARN PACKAGES

FIELD OF THE PRESENT INVENTION

The present invention relates to a method for preventing pattern windings in randomly wound yarn packages at a winding station of a winding machine and, in particular, to such a method wherein the winding roller and the yarn guide of the winding station are accelerated and decelerated by separate drives between respective predetermined maximum and minimum values.

BACKGROUND OF THE PRESENT INVENTION

Patterned windings form in randomly wound yarn packages when the yarn is laid down several times at the same or an adjoining location on the yarn package resulting in ribbon-like yarn layers. Moreover, pattern windings always occur when the winding ratio, i.e., the number of bobbin revolutions to the double stroke of the yarn guide, equals a whole number, and there are several occasions in the course of a winding process of a yarn package when this happens.

Pattern windings considerably interfere with the later unwinding of yarn packages. For instance, because of the inhomogeneous composition of the yarn layers, it is possible for entire yarn layers to be ripped off the yarn package surface during unwinding. In order to produce a high quality yarn package, it is therefore necessary to employ methods for preventing pattern windings.

One conventional method involves the varying of the winding ratio particularly during occasions when pattern windings are known to occur. For instance, a winding machine is known from Swiss Patent 215 637 where yarn packages are driven by friction rollers and a toothed wheel gear having a preset gear ratio connects the drive of the friction rollers with the drive of the yarn guides. The circumferential speed of the friction rollers is continuously varied between a maximum and a minimum value and the number of strokes of the yarn guide is subsequently varied because of the toothed wheel gear. A disadvantage to this method is that a fixed gear is structurally elaborate and it is necessary to keep appropriate toothed wheel gears on hand for changing the gear transmission when, for example, a new roller geometry is used.

Another method and apparatus having an electronic control between drives of the winding rollers and the yarn guides is disclosed in German Patent Publication DE 25 34 239 C2. In this reference, separate drive motors are provided for driving the yarn guides and for driving the winding rollers which drive the yarn packages, with an electronic gear connecting the two drive motors. In the method and apparatus the rpm of the drive motor for driving the yarn guide is arbitrarily changed while the drawing speed is maintained substantially constant with the aid of the electronic gear.

A method for randomly winding yarn packages wherein yarn is also supplied at a constant yarn running speed is known from German Patent Publication DE 43 37 891 A1. In this method, a non-periodic change of the traversing speed is performed for preventing pattern windings. Specifically, the maximum and minimum values of the traversing speed, whereat respective switching from acceleration to deceleration and vice versa occur (the reversing points), are varied within predetermined limits by a computer.

A common drawback to the two previous methods is that each requires a large outlay in control techniques for coordinating the drives of the friction rollers and the yarn guides whereby the resultant drawing speed of the yarn is maintained substantially constant. It is therefore an objective of the present invention to provide a simplified method for preventing pattern windings.

SUMMARY OF THE PRESENT INVENTION

Briefly summarized, the method of the present invention used for preventing pattern windings in a randomly wound yarn package at a winding station of a textile winding machine includes the steps of:

(a) increasing and decreasing the speed of a winding roller of a winding station between a predetermined maximum circumferential speed value and a predetermined minimum circumferential speed value;

(b) increasing and decreasing the speed of a yarn guide of the winding station between a predetermined maximum traversing speed value and a predetermined minimum traversing speed value;

(c) selecting one of the circumferential speed and traversing speed as a command variable and the other as a secondary variable; and (d) generating a signal each time the command variable equals a respective predetermined value;

(e) with the increasing and decreasing of the secondary variable including:

(i) if the secondary variable equals a predetermined value, maintaining the secondary variable at the predetermined value until generating of a signal; and (ii) at a moment of generating a signal:

(A) decreasing the secondary variable if a previous change in the secondary variable immediately prior to generating the signal was an increase in the secondary variable; and (B) increasing the secondary variable if a previous change in the secondary variable immediately prior to generating the signal was a decrease in the secondary variable.

In accordance with the method of the present invention, a drive including a shaft and a motor is provided for the winding roller and a drive including a shaft and a motor independent from the first drive is provided for the yarn guide, with each motor being operated within a predetermined rpm range whereby the circumferential speed of the winding roller and the traversing speed of the yarn guide range between the respective predetermined minimum and predetermined maximum values. Furthermore, the rpm ranges can be adjusted as needed in relation to the yarn parameters of each winding process. The so-called pattern disruption stroke, i.e., the difference between the highest and lowest traversing speeds, is as a rule set for a respective 5% deviation from a mean value; however, settings within a range between approximately 1% to 20% are possible. Furthermore, changes in the circumferential speed of the winding roller per unit of time (the acceleration and deceleration of the winding roller), and changes in the traversing speed of the yarn guide per unit of time (the acceleration and deceleration of the yarn guide), are controlled by adjusting the rpm of the respective motors. Additionally, any change in the circumferential speed preferably is compensated by a corresponding change in the traversing speed, and vice-versa, whereby the yarn running speed remains substantially the same during the winding process so that a substantially constant yarn tension is maintained. Thus, the preferred pattern interruption method of the present invention does not alter the yarn tension that would otherwise be experienced in the yarn being wound.

In a feature of the present invention, a simple regulation measure is provided for the circumstance in which the relationship between the command variable and the secondary variable is lost, i.e., when the winding process is interrupted such as, for example, by a normal shutoff of the winding machine or an unexpected power outage. Specifically, when this occurs and the winding process is thereafter resumed, the command variable and the secondary variable are each respectively accelerated to respective preset values. Furthermore, each preset value preferably is the arithmetic mean of the respective variable's predetermined maximum and minimum limit values. When both motors are running at the respective rpm required for maintaining the respective preset values of the circumferential speed and the traversing speed, the change in the circumferential speed of the winding roller and the oppositely directed change in the traversing speed of the yarn guide is again initiated in accordance with the present invention with the synchronization of the changes in the circumferential speed and traversing speed occurring when the command variable attains a predetermined limit value.

Further in accordance with the present invention, either the circumferential speed of the winding roller or the traversing speed of the yarn guide is selected as the so-called "command" variable and the other is selected as the so-called "secondary" variable, with a single signal being generated as a function of the command variable for controlling changes (increases and decreases) in the secondary variable in order to cause an effective pattern disruption.

In one feature of the present invention, the generating of the signal includes the generating of an electric pulse only during the time required for the command variable to change from a first of the predetermined values to a second of the predetermined values. For example, in a preferred method of the present invention a pulse is generated continuously as the command variable is increased from the predetermined minimum value to the predetermined maximum value and is absent when the command variable decreases from the predetermined maximum value to the predetermined minimum value. However, in an alternative feature of the present invention, the generating of the signal includes the generating of an electric pulse only when the command variable equals each predetermined value.

In another feature of the present invention, changes in the secondary variable directly correspond to changes in the command variable. However, it also is contemplated that the changes may occur completely arbitrarily, and thus it is possible that the secondary variable will not even reach a respective predetermined limit value by the time the command variable reaches a respective predetermined limit value, thereby initiating a reversal in the changing of the secondary variable. It is also possible that the secondary variable will reach a respective predetermined limit value before the command variable reaches a respective predetermined limit value; in this case, the secondary variable is maintained at its predetermined limit value until the command variable equals one of its predetermined limit values and initiates a change in the secondary variable.

In a preferred method of the present invention, the circumferential speed of the winding roller is selected as the command variable and each time the circumferential speed of the winding roller reaches a respective predetermined minimum value, the winding roller is accelerated and a signal is generated that triggers the motor of the yarn guide to decrease the traversing speed toward a predetermined minimum value. When the circumferential speed of the winding roller reaches a respective predetermined maximum value, the winding roller is decelerated and a signal is generated that triggers the motor of the yarn guide to increase the traversing speed toward a predetermined maximum value. Furthermore, since the variation of the command variable between its predetermined maximum and minimum values can take place arbitrarily, the winding roller can be accelerated and decelerated at constant rates or accelerated and decelerated at various rates at different time intervals. Alternatively, the winding roller can be accelerated and decelerated at constantly varying rates. Thus, a random generator, for example, can be used to control the change in the command variable between its respective minimum and maximum values.

Additionally, in this preferred method, if the traversing speed reaches its respective predetermined maximum or minimum value before the circumferential speed of the winding roller reaches its respective predetermined minimum or maximum value, then the motor of the yarn guide is driven with the constant rpm required to maintain the predetermined traversing speed until the circumferential speed of the winding roller equals the respective predetermined maximum or minimum value. However, the time at which the traversing speed remains constant should be kept as short as possible in order for the yarn running speed to be maintained substantially constant.

Specifically, this preferred method of the present invention includes the following steps:

(a) accelerating and decelerating a winding roller of a winding station between a predetermined maximum circumferential speed and a predetermined minimum circumferential speed with a first drive;

(b) accelerating and decelerating a yarn guide of the winding station between a predetermined maximum traversing speed and a predetermined minimum traversing speed with a second drive independent of the first drive; and (c) generating a signal when the winding roller arrives at and is changed from each predetermined value;

(d) the accelerating and decelerating of the yarn guide including:

(i) in response to generating a signal when the winding roller arrives at and is decelerated from the predetermined maximum circumferential speed, accelerating the yarn guide; and (ii) in response to generating a signal when the winding roller arrives at and is accelerated from the predetermined minimum circumferential speed, decelerating the yarn guide.

A feature of this preferred method includes: accelerating the yarn guide to the predetermined maximum traversing speed and then maintaining the yarn guide at the predetermined maximum traversing speed before the winding roller arrives at and is accelerated from the predetermined minimum circumferential speed; and, decelerating the yarn guide to the predetermined minimum traversing speed and then maintaining the yarn guide at the predetermined minimum traversing speed before the winding roller arrives at and is decelerated from the predetermined maximum circumferential speed. Another feature includes periodically accelerating and decelerating the winding roller between the predetermined maximum circumferential speed and the predetermined minimum circumferential speed.

In an alternative preferred method of the present invention, the steps include:

(a) accelerating and decelerating a yarn guide of a winding station between a predetermined maximum traversing speed and a predetermined minimum traversing speed with a first drive;

(b) accelerating and decelerating a winding roller of the winding station between a predetermined maximum circumferential speed and a predetermined minimum circumferential speed with a second drive independent of the first drive;

(c) generating a signal when the yarn guide arrives at and is changed from each predetermined value;

(d) with the accelerating and decelerating of the winding roller including:

(i) in response to said generating a signal when the yarn guide arrives at and is decelerated from the predetermined maximum circumferential speed, accelerating the winding roller; and (ii) in response to said generating a signal when the yarn guide arrives at and is accelerated from the predetermined minimum circumferential speed, decelerating the winding roller.

Again, a feature of this preferred method includes: accelerating the winding roller to the predetermined maximum circumferential speed and then maintaining the winding roller at the maximum circumferential speed before the yarn guide arrives at and is accelerated from the predetermined minimum traversing speed; and, decelerating the winding roller to the predetermined minimum circumferential speed and then maintaining the winding roller at the predetermined minimum circumferential speed before the yarn guide arrives at and is decelerated from the predetermined maximum traversing speed. In yet another feature, the method includes periodically accelerating and decelerating the yarn guide between the predetermined maximum traversing speed and the predetermined minimum traversing speed.

It will thus be readily apparent that the method of the present invention can be employed at any winding station wherein the yarn guide and the winding roller are separately driven. Moreover, the method of the present invention can be employed in a winding machine in which two or more separate drives are provided for all the yarn guides and all the winding rollers, respectively, of a plurality of winding stations of a winding machine. The present invention can also be employed with any type of yarn guide, e.g., reverse winding yarn guides, or wing yarn guides, or with yarn guides that are moved by a back-and-forth moving rod.

BRIEF DESCRIPTION OF THE DRAWINGS

Further characteristics and advantages of the present invention will become apparent from the following description and drawings, wherein.

DETAILED DESCRIPTION OF PREFERRED METHODS

Figure 1:
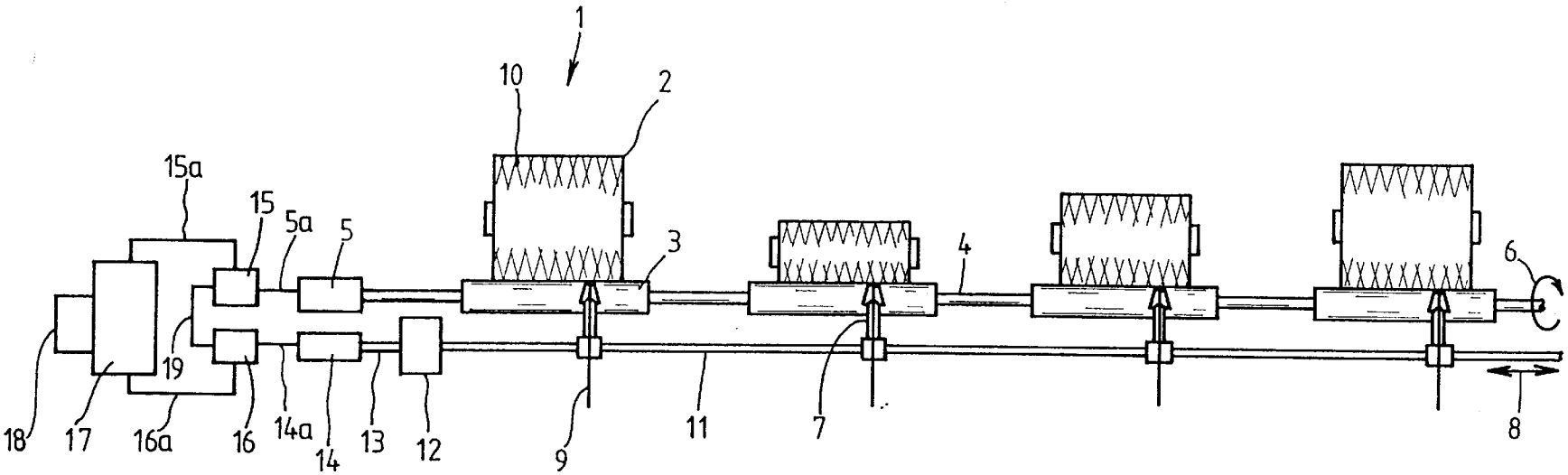
FIG. 1 is a schematic view of a winding machine that performs the method of the present invention.

Several winding stations are shown in FIG. 1 arranged next to each other and are representative of a typical open-end spinning machine. Winding heads 1, which respectively rest on winding rollers 3, are only sketched in the form of yarn packages 2 which are shown in different winding states. The winding rollers 3 are connected with each other by a continuous shaft 4 and are simultaneously driven by the shaft 4 with a motor 5.

While the winding rollers 3 rotate in the direction of the arrow 6 and drive the yarn packages 2, the yarn guides 7 located in front of the yarn packages 2 move back and forth in accordance with the two-headed arrow 8 over the yarn package width thereby placing the yarn 9 in crossed layers 10 on the circumferential surface of the yarn package 2. All yarn guides 7 are arranged on a continuous yarn guide rod 11 which is driven in a back-and-forth motion. In particular, rotary movement of a motor 14 is transferred by a shaft 13 to a special gear 12 that is connected to the yarn guide rod 11.

In executing the preferred method, the two motors 5 and 14 are preferably synchronous motors which are supplied with current by frequency converters 15 and 16, respectively, via lines 5*a* and 14*a*, respectively. By presetting the driving rotary fields, it is advantageously possible to realize every desired rpm change over time. For presetting rotary fields, the frequency converters 15 and 16 are, in turn, connected with a command computer of a central control device 17 via data bus 15*a* and 16*a*, respectively.

The settings of the winding parameters takes place at an entry device 18 connected to the control device 17. Furthermore, the setting of respective maximum and a minimum values for the rpm of the motors 5 and 14 (and hence the setting of the limit values of the circumferential speed and traversing speed, respectively), are entered into the entry device 18. The respective maximum and minimum values of the circumferential speed of the winding rollers 3 and the maximum and minimum values of the traversing speed of the yarn guides 7 are thereby predetermined. It is also possible to preset changes in the respective speeds through the entry device 18.

If desired, asynchronous motors can alternatively be used wherein the revolutions per unit of time for both the shaft 4 and at the shaft 13 are determined by conventional sensors (not shown), and signals for synchronizing the speeds are supplied via control lines (not shown) to the computer of the control device 17.

To perform the preferred method of the present invention, one of two winding variables—the circumferential speed and the traversing speed—is selected as the command variable identified by the designation "U"and the other as the secondary variable identified by the designation "V". Then, once the motor assigned to the command variable has reached a predetermined limit value in the winding process, the frequency converter assigned to the respective motor initiates changes in the command variable opposite to changes therein prior to reaching the predetermined limit value. The frequency converter also generates at that time a signal that causes the other frequency converter assigned to the secondary variable to initiate changes in the secondary variable which are opposite in nature to the changes initiated in the command variable, i.e., if the command variable is increased then the secondary variable is decreased, and vice versa. Thus, for example, the circumferential speed of the winding rollers 3 is selected as the command variable in FIG. 2 and the frequency converter 15 generates a signal each time the command variable (circumferential speed) equals a predetermined limit value via the signal line 19, in response to which the frequency converter 16 of the motor 14 which drives the yarn guide 7 initiates changes in the traversing speed of the yarn guides opposite to the changes in the circumferential speed.

Figure 2:
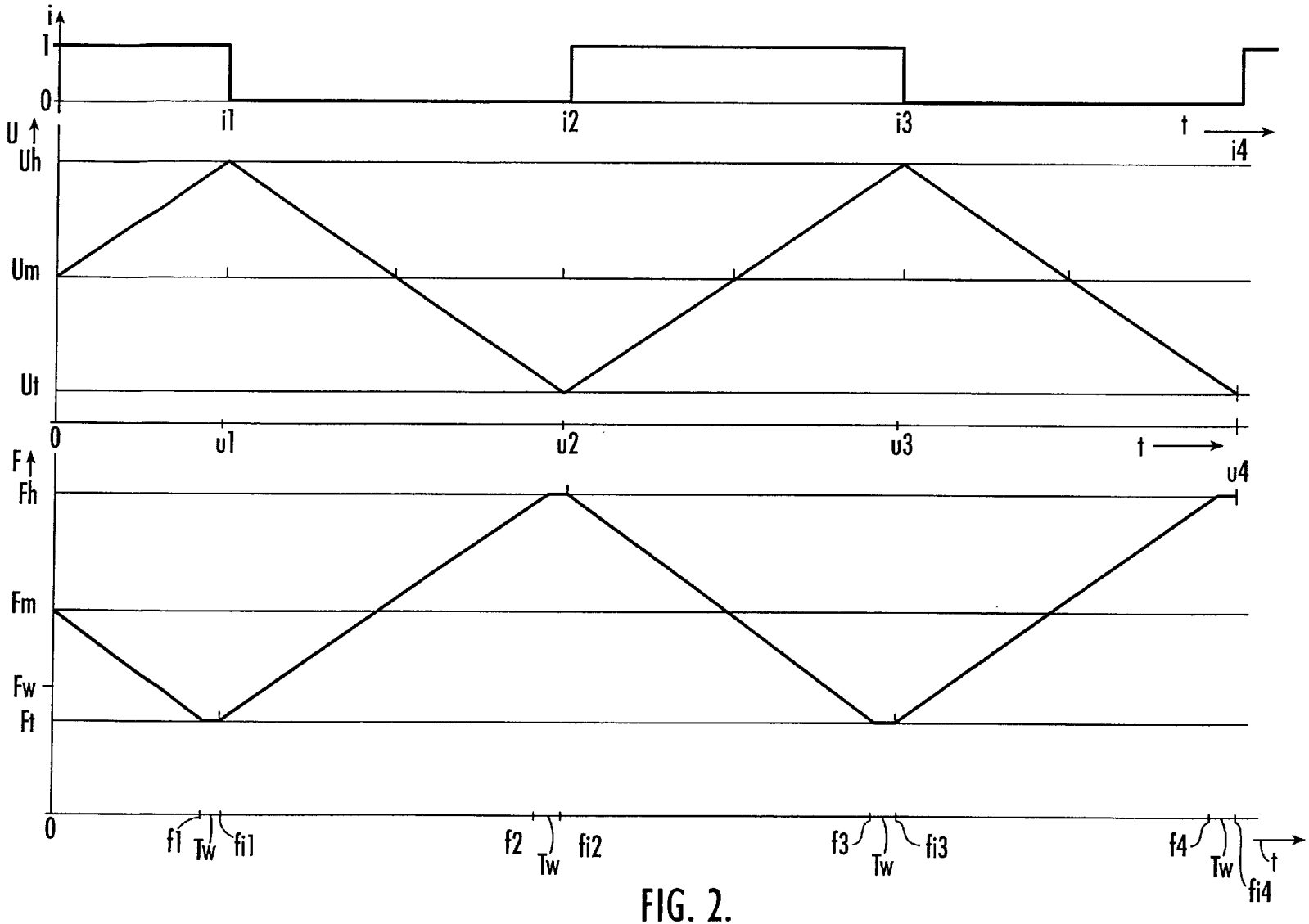
FIGS. 2–4 show graphs of the circumferential speed of a winding roller and the traversing speed of a yarn guide of FIG. 1 over time.

The course of the circumferential speed of a winding roller and the traversing speed of a yarn guide are graphed over the time in FIG. 2. A so-called pulse diagram is also illustrated above the aforesaid two graphs. The courses of the circumferential speed of a winding roller and the traversing speed of a yarn guide shown therein represent a preferred method of the present invention wherein the speed of the winding roller is changed strictly periodically and the circumferential speed is selected as the command variable. At time t=0 when the traversing speed and the circumferential speed have been increased to and are at respective preset values for beginning the method of the present invention, the circumferential velocity U is linearly increased, i.e., at constant acceleration, starting at a mean value $U_m$, to a maximum value $U_n$, which is reached at time $u_1$. The velocity is then adjusted in the opposite direction so that it continuously decreases linearly, i.e., at constant deceleration. In this case it reaches the minimum value $U_t$ at time $u_2$. There an opposite-direction change of the circumferential speed again occurs, i.e., the deceleration is reversed, and the rpm of the motor of the winding roller, and thus the circumferential speed of the winding roller, increases linearly, i.e., at constant acceleration. At time $U_3$ the maximum value $U_n$ of the circumferential speed is again reached and, thereafter, is again reduced at the same constant rate as before to decrease the circumferential speed to the minimum value $U_t$ by time $u_4$. The individual time intervals $(u_2-u_1)$, $(u_3-u_2)$, $(u_4-u_3)$, and twice $u_1$ are equal because of the strictly periodic change of the circumferential speed at constant rates.

The corresponding change of the traversing speed of the yarn guide has been entered over time below the speed-time graph of the winding roller. The traversing speed of the yarn guide varies, starting at a mean value $F_m$, between a minimum value $F_t$ and a maximum value $F_h$. At time t=0, the traversing speed of the yarn guide is decreased linearly, i.e., decelerated at constant rate, starting at the mean value $F_m$. The change in the traversing speed therefore takes place in a direction opposite the change in the circumferential speed of the winding roller; whereas the circumferential speed increases, the traversing speed decreases. Furthermore, the change in the traversing speed is determined so that the respective limit values $F_t$ or $F_h$ are reached before the circumferential speed equals the predetermined limit values. In particular, the traverse speed reaches the predetermined lower limit value $F_t$ at time $f_1$. In accordance with the preferred method, the yarn guides are then operated at this traversing speed until the circumferential speed of the winding rollers equals the predetermined maximum value $U_n$ after the time interval $T_w$.

Above the graph for the winding roller, an additional graph of a pulse sequence i is shown over time t. Two types of pulse delivery are preferable: either a pulse is generated by a control device when the circumferential speed equals the limit values; or a pulse is continuously generated during the time occurring between two limit values. In the preferred method discussed, a signal sequence is selected whereby a pulse i is generated from the starting time t=0 until the maximum value of the circumferential speed of the winding roller is reached. As soon as a change in the circumferential speed of the winding roller in the direction toward the predetermined minimum value is started, the pulse i ceases (time $i_1$) and, in turn, the absence of the pulse signals the drive of the yarn guide to increase the traversing speed. Moreover, time $f_{i1}$ coincides with time $u_1$ when the circumferential speed reaches the predetermined maximum value $U_n$. The difference between the time $f_1$, when the traversing speed of the yarn guide reaches the predetermined minimum value, and the time $f_{i1}$ when the increase in the traversing speed is initiated, is equal to $T_w$, which is the waiting time.

Starting at the time $f_{i1}$ the traversing speed of the yarn guide increases until it reaches the predetermined maximum value $F_h$ at time $f_2$. This time falls short of the time $u_2$ by exactly the waiting time $T_w$, the time $u_2$ being the time at which the circumferential speed of the winding roller equals the minimum value $U_t$. The yarn guide traverses during the waiting time $T_w$ with the maximum speed $F_h$ until the circumferential speed of the winding roller is again increased at time $u_2$. Time $f_{i2}$ coincides with time $u_2$, after which the pulse i is again generated at time $i_2$, thereby signaling the drive of the yarn guide to change the traversing speed in the opposite direction to the change in the circumferential speed, i.e., to reduce the traversing speed in linear manner so that the minimum value $f_t$ is reached again at time $f_3$. The time interval $(f_3-f_{i2})$ required to do this is again shorter than the time interval $(u_3-u_2)$ by the waiting time $T_w$. Furthermore, at time $f_{i3}$ the circumferential speed of the winding roller again equals the predetermined maximum value $U_n$ for the second time and the pulse i is again ceased at time $i_3$, which in turn signals the drive of the yarn guide to initiate changes in the traversing speed in the opposite direction to the changes in the circumferential speed until the maximum traversing speed $f_h$ is reached again at time interval $f_4$. The process is then again repeated and continued during the winding process.

Figure 3:
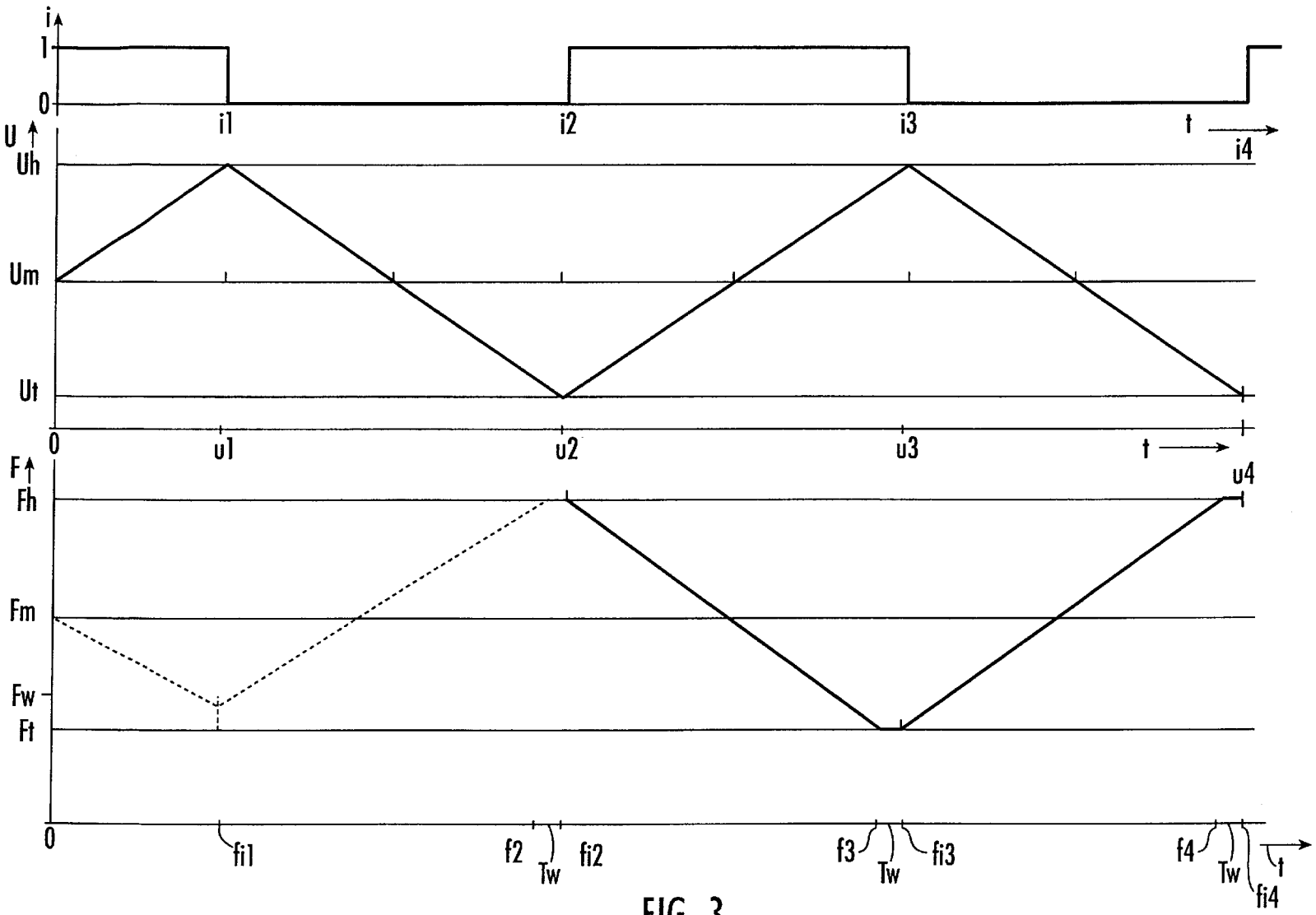
Figure 4:
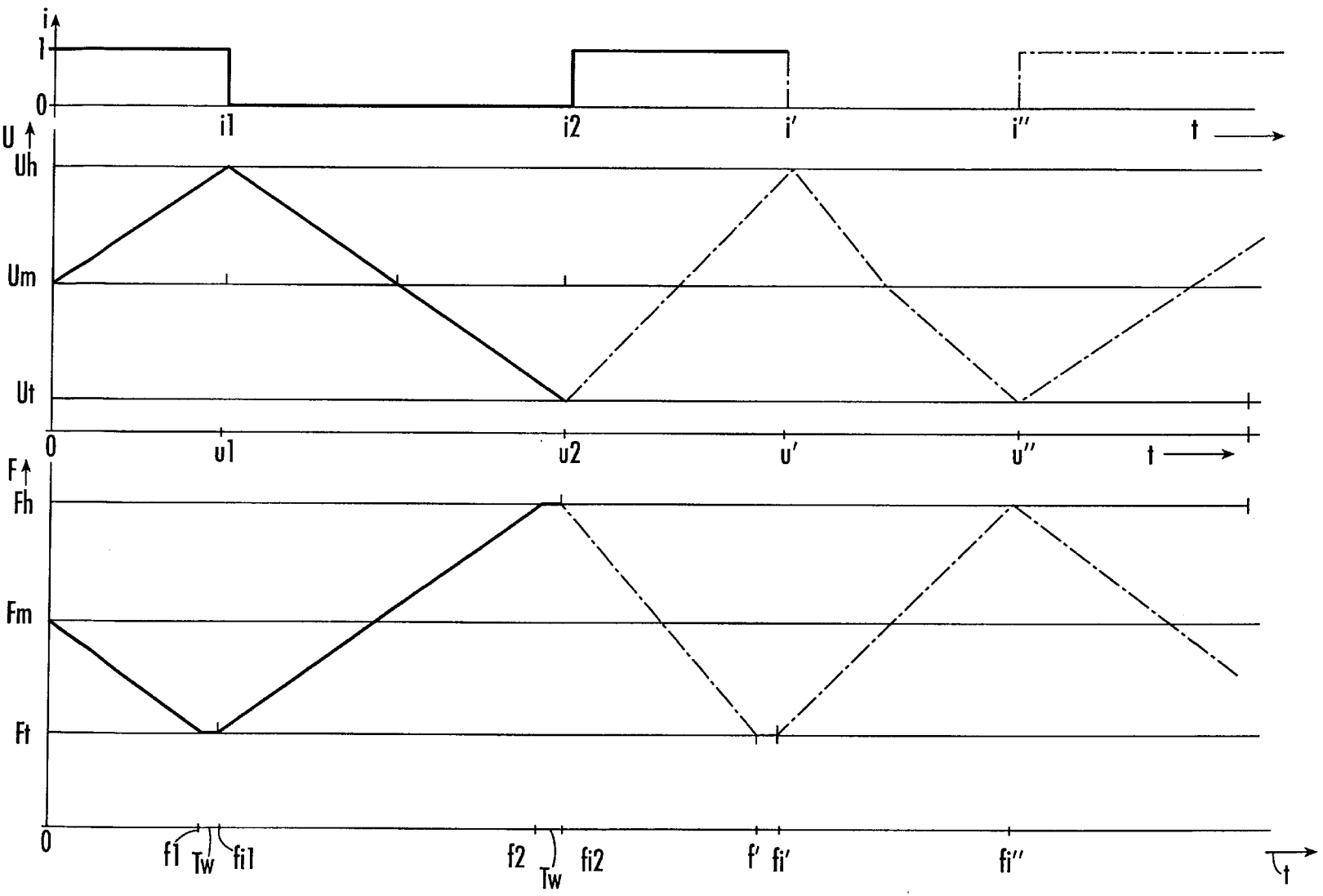

The preferred method shows a periodic change of the circumferential speed of the winding roller wherein the acceleration and deceleration rates are constant for the circumferential speed and traversing speed. However, it is also possible to vary the respective acceleration and deceleration rates, examples of which are also represented in the graphs of FIGS. 2–4. First, within time $u_1$, the traversing speed (the secondary variable) decreases toward the predetermined minimum value more slowly, as is shown in dashed lines in FIG. 3. The circumferential speed (the command variable) reaches the predetermined maximum value at time $u_1$ when the traversing speed has only reached the value $F_w$. Nevertheless, even though the traversing speed has not attained the predetermined minimum value, the pulse i ends at time $i_1$ equal to time $u_1$ and the changes in the traversing speed are reversed.

In another example shown in FIG. 4, time interval $(u''-u_2)$, the circumferential speed is shown changing at different rates in the time periods from $u_2$ to U' (uniform through the entire time period) and u' to u" (two uniform rates; a first rate before reaching the mean speed $U_m$ and a second slower rate after reaching the mean speed $U_m$). This course of the circumferential speed is shown in dash-dotted lines in FIG. 4.

Within the same time interval $(u''-u_2)$, the traversing speed (the secondary variable) is shown changing at a constant rate whereby the secondary variable reaches the predetermined minimum value at time f and remains at this value until it is caused to increase in response to the absence of the pulse i at time i' equal to $f_i'$. Subsequently the traversing speed changes at a constant rate whereby the secondary variable reaches the predetermined maximum value at the same time fi" as the circumferential speed reaches the predetermined minimum value at time u". The traversing speed is then caused to decrease by the generation of the pulse signal i at time i" equal to $f_i''$.

It thus can be seen from the graphs that only a single signal is required for controlling the secondary variable, i.e., the traversing speed in the preferred method. This signal is respectively triggered when the command variable, i.e., the circumferential speed of the winding roller, equals a predetermined limit value. Furthermore, it will readily be apparent that the graphs in FIG. 2 could just as easily represent an alternative preferred method in which the traversing speed is selected as the command variable and identified by U and the circumferential speed is selected as the secondary variable and identified by F.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to the preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for preventing pattern windings in a randomly wound yarn package at a winding station of a textile winding machine, including the steps of:

(a) accelerating and decelerating a winding roller of a winding station between a predetermined maximum circumferential speed and a predetermined minimum circumferential speed with a first drive;

(b) accelerating and decelerating a yarn guide of the winding station between a predetermined maximum traversing speed and a predetermined minimum traversing speed with a second drive independent of the first drive; and (c) generating a signal only when the winding roller arrives at and is changed from each predetermined circumferential speed;

(d) said accelerating and decelerating of the yarn guide including:

(i) in response to said generating a signal when the winding roller arrives at and is decelerated from the predetermined maximum circumferential speed, accelerating the yarn guide; and (ii) in response to said generating a signal when the winding roller arrives at and is accelerated from the predetermined minimum circumferential speed, decelerating the yarn guide.

2. The method in accordance with claim 1, wherein said accelerating and decelerating of the yarn guide includes:

accelerating the yarn guide to the predetermined maximum traversing speed and then maintaining the yarn guide at the predetermined maximum traversing speed before the winding roller arrives at and is accelerated from the predetermined minimum circumferential speed; and decelerating the yarn guide to the predetermined minimum traversing speed and then maintaining the yarn guide at the predetermined minimum traversing speed before the winding roller arrives at and is decelerated from the predetermined maximum circumferential speed.

3. The method in accordance with claim 1, further including periodically accelerating and decelerating the winding roller between the predetermined maximum circumferential speed and the predetermined minimum circumferential speed.

4. The method in accordance with claim 1, further comprising restarting the winding process following an interruption thereof, including the steps of:

increasing the circumferential speed and traversing speed to respective preset values between the respective predetermined maximum and minimum values, and then resuming said respective acceleration and deceleration of the winding roller and yarn guide and said generating of said signals.

5. The method in accordance with claim 1, further comprising restarting the winding process following an interruption thereof, including the steps of:

increasing the circumferential speed and traversing speed to respective arithmetic means of their predetermined maximum and minimum values, and then resuming said respective acceleration and deceleration of the winding roller and yarn guide and said generating of said signals.

6. The method in accordance with claim 1, wherein the first and second drives each include a synchronous motor.

7. A method according to claim 1, wherein said step of generating a signal comprises one of the group of:

(a) generating an electric pulse only when the circumferential speed of the winding roller equals and is changed from each predetermined circumferential speed, and (b) generating an electric pulse only during the transition of the winding roller from one of the predetermined maximum and minimum circumferential speeds to the other of the predetermined maximum and minimum circumferential speeds.

8. A method for preventing pattern windings in a randomly wound yarn package at a winding station of a textile winding machine, including the steps of:

(a) accelerating and decelerating a yarn guide of a winding station between a predetermined maximum traversing speed and a predetermined minimum traversing speed with a first drive;

(b) accelerating and decelerating a winding roller of the winding station between a predetermined maximum circumferential speed and a predetermined minimum circumferential speed with a second drive independent of the first drive; and (c) generating a signal only when the yarn guide arrives at and is changed from each predetermined traversing speed;

(d) said accelerating and decelerating of the winding roller including:

(i) in response to said generating a signal when the yarn guide arrives at and is decelerated from the predetermined maximum traversing speed, accelerating the winding roller; and (ii) in response to said generating a signal when the yarn guide arrives at and is accelerated from the predetermined minimum traversing speed, decelerating the winding roller.

9. The method in accordance with claim 8, wherein said accelerating and decelerating of the winding roller includes:

accelerating the winding roller to the predetermined maximum circumferential speed and then maintaining the winding roller at the maximum circumferential speed before the yarn guide arrives at and is accelerated from the predetermined minimum traversing speed; and decelerating the winding roller to the predetermined minimum circumferential speed and then maintaining the winding roller at the predetermined minimum circumferential speed before the yarn guide arrives at and is decelerated from the predetermined maximum traversing speed.

10. The method in accordance with clain 8, further including periodically accelerating and decelerating the yarn guide between the predetermined maximum traversing speed and the predetermined minimum traversing speed.

11. The method in accordance with claim 8, further comprising restarting the winding process following an interruption thereof, including the steps of:

increasing the circumferential speed and traversing speed to respective preset values between the respective predetermined maximum and minimum values, and then resuming said respective acceleration and deceleration of the winding roller and yarn guide and said generating of said signals.

12. The method in accordance with claim 8, further comprising restarting the winding process following an interruption thereof, including the steps of:

increasing and decreasing the traversing speed and circumferential speed to respective arithmetic means of their predetermined maximum and minimum values, and then resuming said respective acceleration and deceleration of the yarn guide and winding roller and said generating of said signals.

13. The method in accordance with claim 8, wherein the first and second drives each include a synchronous motor.

14. A method according to claim 8, wherein said step of generating a signal comprises one of the group of:

(a) generating an electric pulse only when the traversing speed of the yarn guide equals and is changed from each predetermined traversing speed, and (b) generating an electric pulse only during the transition of the yarn guide from one of the predetermined maximum and minimum traversing speeds to the other of the predetermined maximum and minimum traversing speeds.

15. A method for preventing pattern windings in a randomly wound yarn package at a winding station of a textile winding machine, including the steps of:

(a) increasing and decreasing the speed of a winding roller of a winding station between a predetermined maximum circumferential speed value and a predetermined minimum circumferential speed value;

(b) increasing and decreasing the speed of a yarn guide of the winding station between a predetermined maximum traversing speed value and a predetermined minimum traversing speed value;

(c) selecting one of the speed of the winding roller and the speed of the yarn guide as a command variable and the other as a secondary variable; and (d) generating a signal only when the command variable equals a respective maximum predetermined value and when the command variable equals a respective minimum predetermined value;

(e) said increasing and decreasing of the secondary variable including in response to said generating of a signal:

(i) decreasing the secondary variable if a last value change in the secondary variable prior to said generating of the signal was an increase in the secondary variable; and (ii) increasing the secondary variable if a last value change in the secondary variable prior to said generating of the signal was a decrease in the secondary variable.

16. A method according to claim 15, wherein said step of generating a signal comprising one of the group of:

(a) generating an electric pulse only when the command variable equals a respective maximum predetermined value and when the command variable equals a respective minimum predetermined value, and (b) generating an electric pulse only during the transition of the command variable from one of the respective predetermined maximum and minimum values to the other of the respective predetermined maximum and minimum values.

17. A method according to claim 15, further including the step of maintaining the secondary value at a respective predetermined value once reached during said accelerating and decelerating thereof, but only until the next subsequent generating of a signal.

18. A method for preventing pattern windings in a randomly wound yarn package at a winding station of a textile winding machine, including the steps of:

(a) accelerating and decelerating a winding roller of a winding station between a predetermined maximum circumferential speed and a predetermined minimum circumferential speed with a first drive;

(b) accelerating and decelerating a yarn guide of the winding station between a predetermined maximum traversing speed and a predetermined minimum traversing speed with a second drive independent of the first drive; and (c) generating a signal when the winding roller arrives at and is changed from each predetermined value;

(d) wherein said accelerating and decelerating of the yarn guide includes, (i) in response to said generating a signal when the winding roller arrives at and is decelerated from the predetermined maximum circumferential speed, accelerating the yarn guide; and (ii) in response to said generating a signal when the winding roller arrives at and is accelerated from the predetermined minimum circumferential speed, decelerating the yarn guide; and (e) wherein said accelerating and decelerating of the yarn guide further includes:

(i) accelerating the yarn guide to the predetermined maximum traversing speed and then maintaining the yarn guide at the predetermined maximum traversing speed before the winding roller arrives at and is accelerated from the predetermined minimum circumferential speed; and (ii) decelerating the yarn guide to the predetermined minimum traversing speed and then maintaining the yarn guide at the predetermined minimum traversing speed before the winding roller arrives at and is decelerated from the predetermined maximum circumferential speed.

19. A method for preventing pattern windings in a randomly wound yarn package at a winding station of a textile winding machine, including the steps of:

(a) accelerating and decelerating a yarn guide of a winding station between a predetermined maximum traversing speed and a predetermined minimum traversing speed with a first drive;

(b) accelerating and decelerating a winding roller of the winding station between a predetermined maximum circumferential speed and a predetermined minimum circumferential speed with a second drive independent of the first drive; and (c) generating a signal when the yarn guide arrives at and is changed from each predetermined value;

(d) wherein said step of accelerating and decelerating of the winding roller includes, (i) in response to said generating a signal when the yarn guide arrives at and is decelerated from the predetermined maximum circumferential speed, accelerating the winding roller; and (ii) in response to said generating a signal when the yarn guide arrives at and is accelerated from the predetermined minimum circumferential speed, decelerating the winding roller; and (e) wherein said accelerating and decelerating of the winding roller further includes, (i) accelerating the winding roller to the predetermined maximum circumferential speed and then maintaining the winding roller at the maximum circumferential speed before the yarn guide arrives at and is accelerated from the predetermined minimum traversing speed; and (ii) decelerating the winding roller to the predetermined minimum circumferential speed and then maintaining the winding roller at the predetermined minimum circumferential speed before the yarn guide arrives at and is decelerated from the predetermined maximum traversing speed.

* * * * *